US005641197A

United States Patent [19]

Springmann

[11] Patent Number: 5,641,197

[45] Date of Patent: Jun. 24, 1997

[54] COLLAPSIBLE SPORTS CHAIR

[76] Inventor: Lloyd G. Springmann, 13 Jacqueline Ct., Mandeville, La. 70471

[21] Appl. No.: 523,281

[22] Filed: Sep. 5, 1995

[51] Int. Cl.[6] ..... A47C 7/62

[52] U.S. Cl. ..... 297/188.11; 297/188.04; 297/188.06; 297/188.12; 248/512; 248/513

[58] Field of Search ..... 297/188.11, 188.12, 297/188.13, 188.14, 188.06, 188.04, 188.16, 188.15; 248/535, 534, 512, 513; 312/235.5

[56] References Cited

U.S. PATENT DOCUMENTS

| | | | |
|---|---|---|---|
| D. 190,429 | 5/1961 | Hoagland | 248/513 X |
| 1,039,554 | 9/1912 | Lindhorst | 248/513 |
| 1,266,681 | 5/1918 | Harvie | 248/513 |
| 1,890,048 | 12/1932 | Flintermann | 297/188.12 X |
| 3,014,759 | 12/1961 | Bing | 297/188.06 |
| 3,230,006 | 1/1966 | Sakolis | 297/188.11 X |
| 3,623,683 | 11/1971 | Bennett | 297/188.12 X |
| 4,176,819 | 12/1979 | Lowe | 248/513 |
| 4,466,659 | 8/1984 | Carpentier et al. | 297/188.06 |
| 4,527,830 | 7/1985 | Meyers | 297/188.11 X |
| 4,624,502 | 11/1986 | Boole | 297/188.11 |
| 4,650,245 | 3/1987 | Nazar | 297/188.13 |
| 4,790,432 | 12/1988 | Rees | 297/188.11 X |
| 4,799,731 | 1/1989 | Brown | 297/188.12 |
| 4,807,929 | 2/1989 | Balsbaugh | 297/188.04 |
| 4,811,438 | 3/1989 | Simpson | 297/188.11 X |
| 4,869,195 | 9/1989 | Eichfeld | 248/513 X |
| 4,871,099 | 10/1989 | Bogar, Jr. | 248/512 X |
| 4,948,197 | 8/1990 | Sansing | 297/188.14 |
| 5,046,433 | 9/1991 | Kramer et al. | 297/188.06 X |
| 5,110,184 | 5/1992 | Stein et al. | 297/188.14 X |
| 5,269,157 | 12/1993 | Ciminelli et al. | 297/188.04 X |
| 5,288,001 | 2/1994 | Locarno | 297/188.06 X |
| 5,350,215 | 9/1994 | DeMars | 297/188.14 |
| 5,409,291 | 4/1995 | Lamb et al. | 297/188.12 X |

FOREIGN PATENT DOCUMENTS

| | | | |
|---|---|---|---|
| 112315 | 10/1964 | Czech Rep. | 297/188.11 |
| 2569948 | 3/1986 | France | 297/188.12 |
| 604415 | 7/1948 | United Kingdom | 297/188.12 |
| 766934 | 1/1957 | United Kingdom | 312/235.5 |

*Primary Examiner*—Peter M. Cuomo
*Assistant Examiner*—Rodney B. White
*Attorney, Agent, or Firm*—Joseph N. Breaux

[57] ABSTRACT

An improved collapsible sports chair of the type having a collapsible chair assembly including a collapsing frame having four leg members, a seat support member supported by the four leg members, and a back support member hingedly connected to the seat support member wherein the improvement comprises the addition of a cooler assembly, including a rail mechanism and a cooler member slidably connected with the rail mechanism, secured beneath the seat support member; a multi-position umbrella support mechanism, secured to the back surface of the back support member; and a flexible storage bag member having four flexible tether members each including a securing clip attached to the distal end thereof, each securing clip being insertable within one of four securing clip receiving members provided on the back surface of the back support member.

1 Claim, 6 Drawing Sheets

COLLAPSIBLE SPORTS CHAIR

TECHNICAL FIELD

The present invention relates to portable devices for supporting spectators at sporting events and more particularly to portable, collapsible, chairs that are utilized for comfortably supporting a spectator at a sporting event or other outdoor activity.

BACKGROUND ART

Many sporting events such as children's baseball, football and soccer league games take place out of doors. Because these events take place outdoors, it is often difficult to obtain comfortable seating suitable for enjoying the games. In addition, children's league facilities often lack adequate sun and/or rain protection for spectators. Also, refreshment facilities may be a long distance from the game site or may be nonexistent. It would be a benefit, therefore, to have a portable sports chair that was collapsible for easy transportation to and from the sporting event. It would be a further benefit if the sports chair included a mounting mechanism for positioning an umbrella at various positions with respect to the spectator in order to allow for more convenient positioning of the sports chair at the sporting event. It would also be a benefit if the sports chair included a chamber for storing and keeping cool a supply of beverages. It would also be a benefit if the sports chair included a storage facility for storing supplies such as sun screen, mosquito repellant, hats, towels, reading material etc.

GENERAL SUMMARY DISCUSSION OF INVENTION

It is thus an object of the invention to provide a collapsible sports chair that includes a mechanism for holding an umbrella in a variety of positions with respect to a spectator seated within the seat of the chair.

It is a further object of the invention to provide a collapsible sports chair that includes a mechanism for storing and maintaining a supply of beverages in a cool condition.

It is a still further object of the invention to provide a collapsible sports chair that includes a storage facility for conveniently storing items in connection with the chair when not immediately needed.

It is a still further object of the invention to provide a collapsible sports chair that achieves all or some of the above mentioned objects.

Accordingly, an improved collapsible sports chair of the type having a collapsible chair assembly including a collapsing frame having four leg members, a seat support member supported by the four leg members, and a back support member hingedly connected to the seat support member is provided. The improvement comprises the addition of a cooler assembly including a rail mechanism and a cooler member slidably connected with the rail mechanism, secured beneath the seat support member; a multi-position umbrella support mechanism, secured to the back surface of the back support member; and a flexible storage bag member having four flexible tether members each including a securing clip to the distal end thereof, each securing clip being matably connectable with one of four securing clip receiving members provided on the back surface of the back support member.

The improved sports chair preferably also includes a detachable carrying strap securable to the sports chair no assist in transporting the sports chair to and from sporting events. In addition it is also preferred that the sports chair include at least one arm rest having a beverage support cavity formed through the top surface thereof for convenient hands free support of a beverage while viewing the sporting event. The support cavity is preferably cylindrically shaped and sized to accommodate a container having up to about a three inch diameter.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
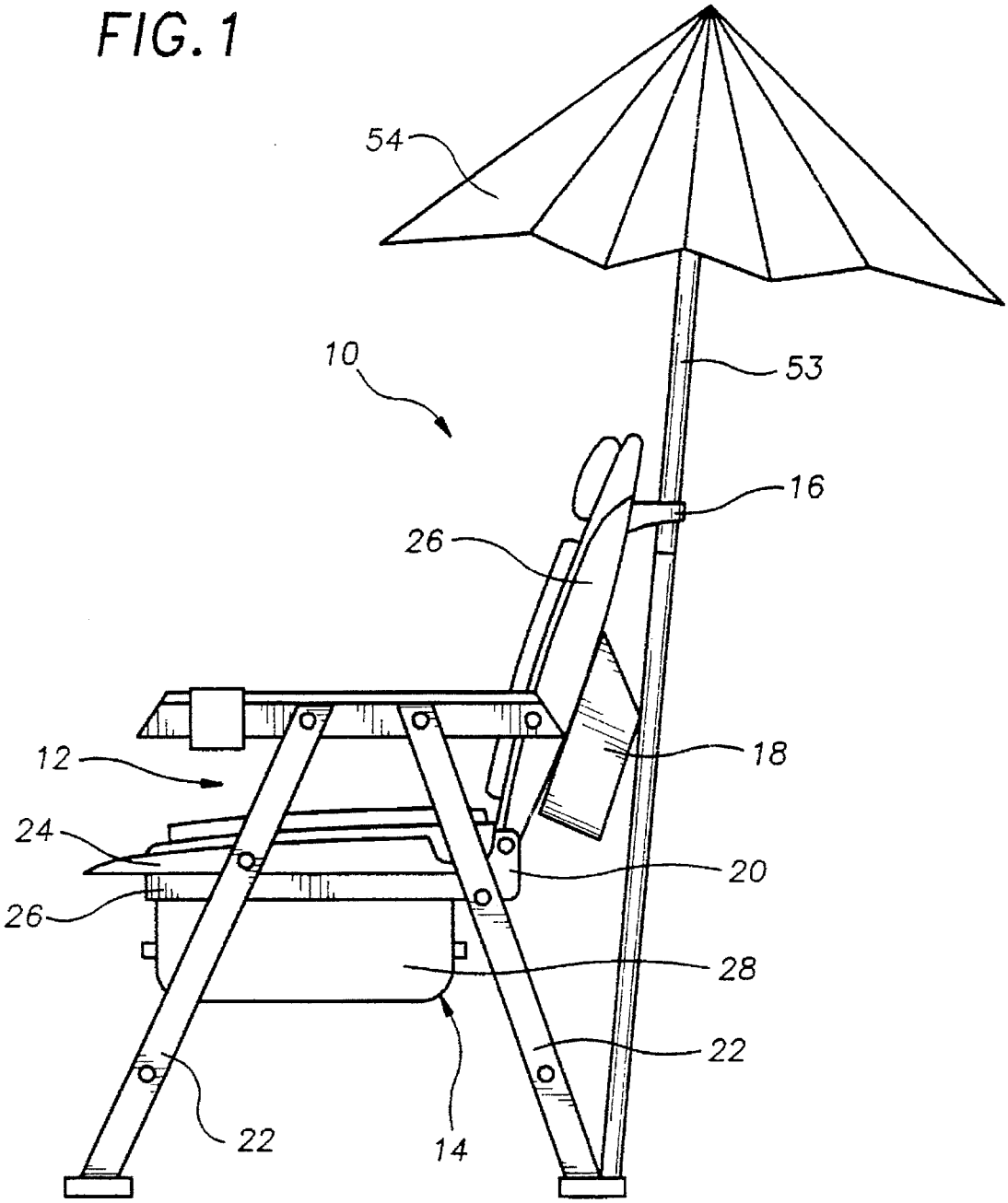
FIG. 1 is a side view of an embodiment of the collapsible sports chair of the invention supporting a representative umbrella.

FIG. 1 shows an embodiment of the improved, collapsible sports chair of the present invention generally designated by the numeral 10. Sports chair 10 includes a conventional, collapsible chair assembly, generally referenced by the numeral 12; a cooler assembly, generally referenced by the numeral 14; a multi-position umbrella support mechanism 16; and a flexible storage bag member 18.

Chair assembly 12 includes a collapsing frame 20 having four leg members 22 (only two shown in FIG. 1), a seat support member 24 supported by leg members 22, and a back support member 26 hingedly connected to seat support member 24.

Figure 2:
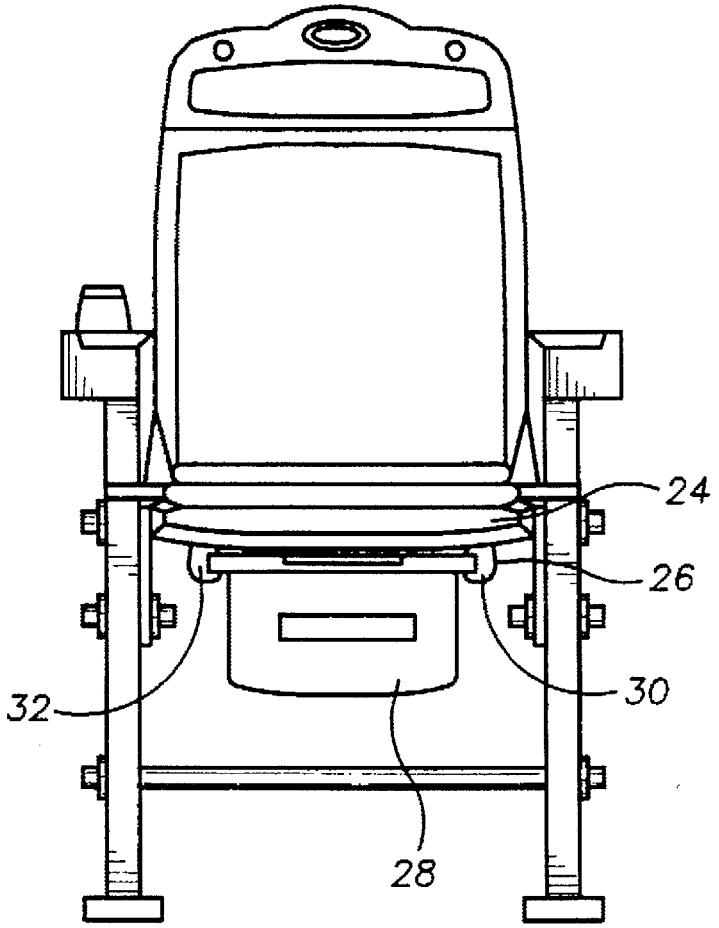
FIG. 2 is a front view of the sports chair of FIG. 1 showing the cooler member slidably mounted on the rail mechanism underneath the seat support member.
Figure 2A:
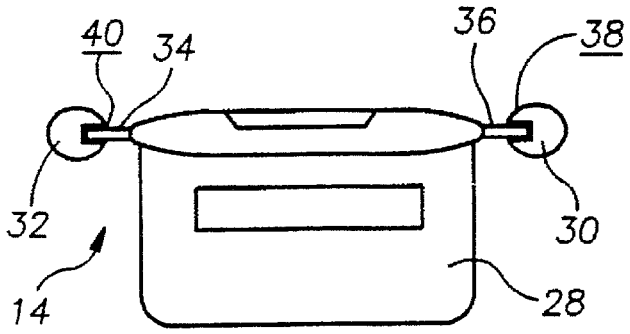
FIG. 2A is a front, detail view showing the rail mechanism and the cooler member.
Figure 2B:
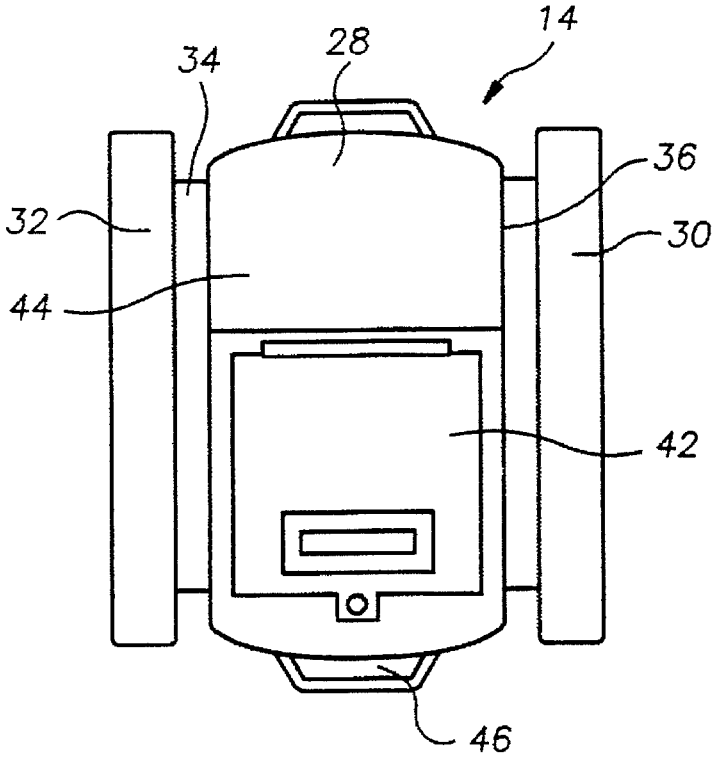
FIG. 2B is a top view of cooler member showing a hinged access panel for accessing the insulated chamber of the cooler member.

As shown in the figure, cooler assembly 14 includes a rail mechanism 27 and a cooler member 28. Rail mechanism 26 is secured beneath seat support member 24. Cooler member 28 is slidably connected with the rail mechanism 27. Rail mechanism 27 is more clearly shown in FIG. 2. As shown in the figure, rail mechanism 27 includes two parallel oriented, spaced rail members 30,32 secured to the bottom surface of seat support member 24. With reference to FIG. 2A, a isolated side view of cooler assembly 14, cooler member 28 is a soft sided, insulated cooler that includes two traveler members 34,36 that extend outwardly from the top sidewalls of cooler member 28 and fit within channels 38,40 formed to within rail members 30,32. FIG. 2B is an isolated, top view of cooler assembly 14 showing traveler members 34,36 slidably disposed within rail members 32,30 respectively and a lid member 42 hingedly secured to a top surface 44 that selectively cover an access opening into a conventional insulated storage chamber formed within cooler member 28. Lid member 42 includes a snap closure 43 for securing lid member 42 over the access opening. A grip 46 is provided to ease removal of cooler member 28 from its storage position supported between rail members 30,32. Two carrying handles 45,47 are provided for carrying cooler member 28 independently from chair assembly 12.

Figure 3:
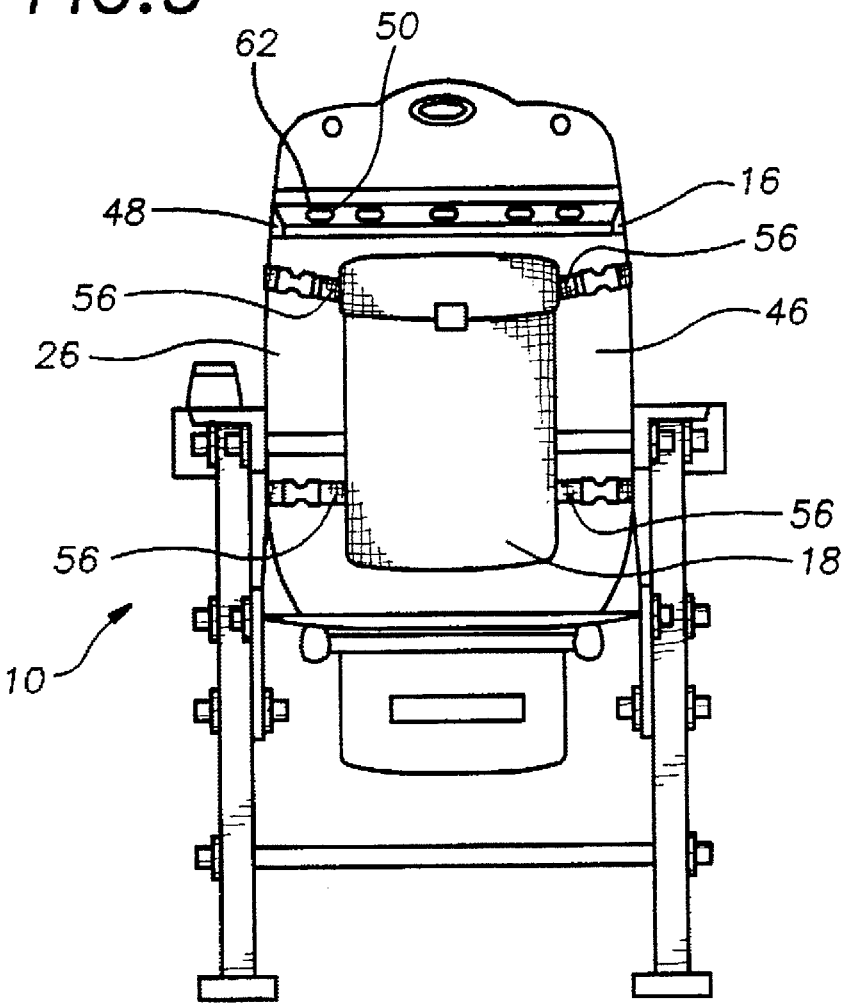
FIG. 3 is a back view of the embodiment of the sports chair showing the umbrella support mechanism and the storage bag.

FIG. 3 is a back view of sports chair 10 showing umbrella support mechanism 16 and storage bag 18 secured to a back surface 46 of back support member 26. In this embodiment, umbrella support mechanism 16 is constructed from an elongated structure 48 having five cylindrically shaped apertures 50 formed therethrough. A tubular shaped resilient bushing 52 is adhesively secured within each cylindrically shaped aperture 50. The interior diameter of resilient bushing 52 is selected to allow bushing 52 to frictionally contact and grip the support pole 53 of an umbrella 54 (as shown in FIG. 1).

Figure 4:
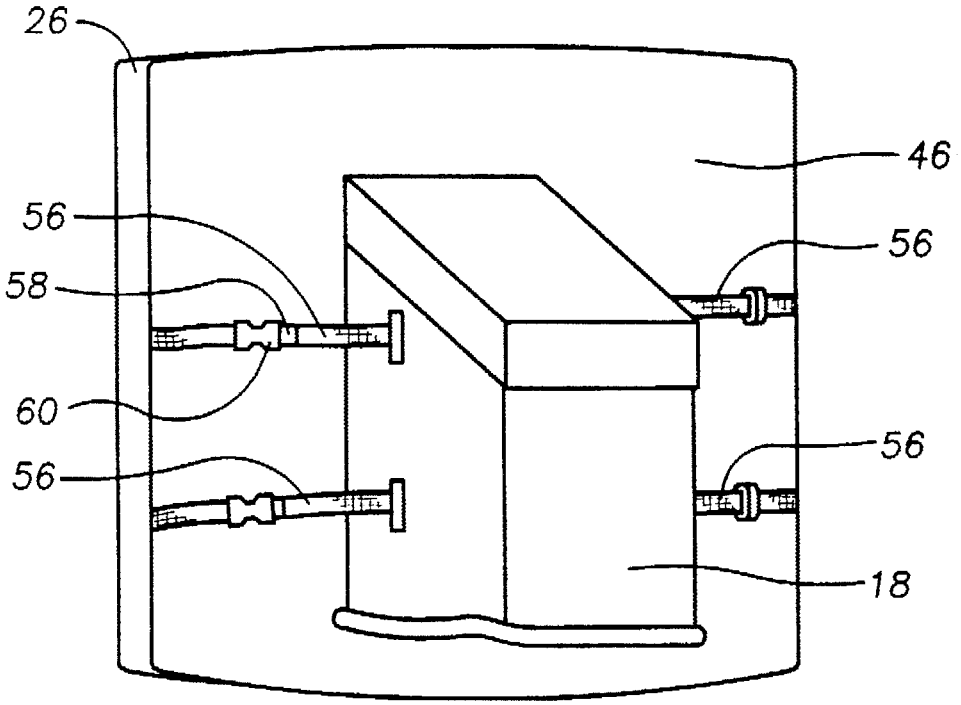
FIG. 4 is a perspective, detail view of the storage bag showing the four securing clips and the four securing clip receiving members secured to the back surface of the back support member.

As shown in the figure, storage bag 18 is secured to back surface 46 with four flexible tether members 56. With reference to FIG. 4, each tether member 56 including a securing clip 58 attached to the distal end thereof. Each securing clip is insertable within one of four securing clip receiving members 60 provided on back surface 46 of back support member 26. Detachably securing bag member 18 allows bag member 18 to be removed and laundered as needed.

Figure 5:
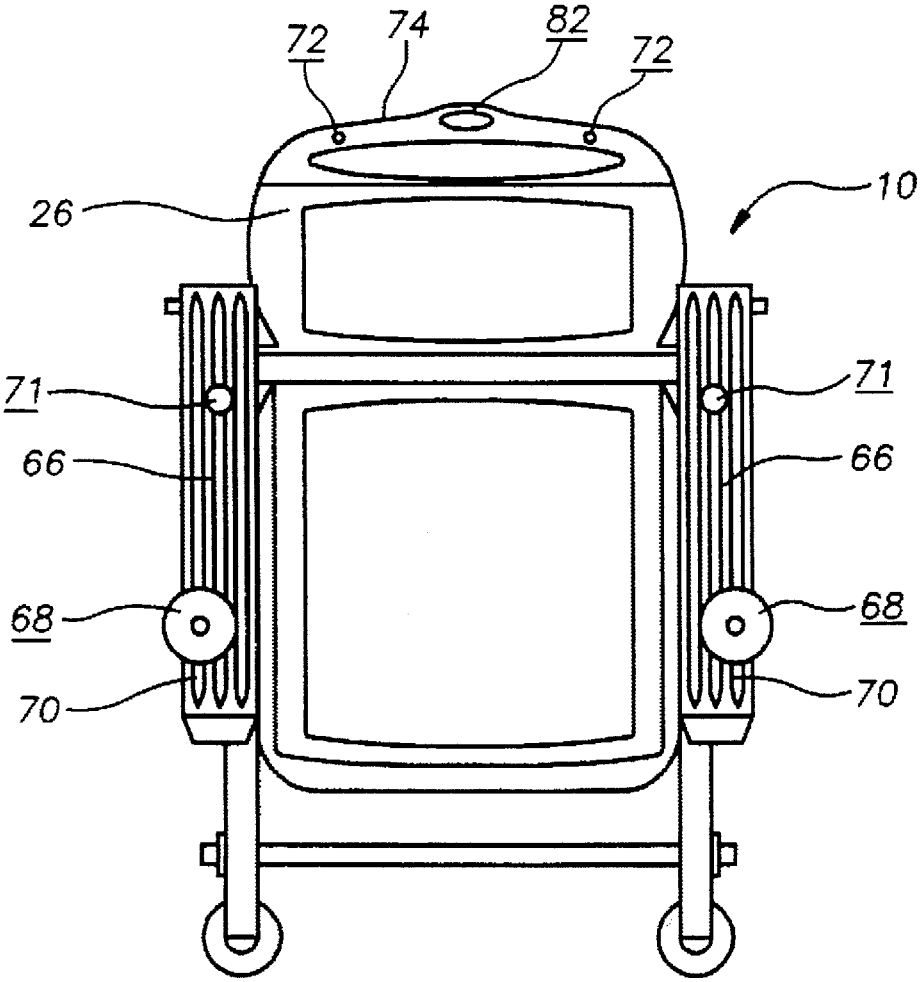
FIG. 5 is a top view of the embodiment of the sports chair showing the drink holding recesses formed in the top surfaces of the handrails.

FIG. 5 is a top view of sports chair 10 showing arm rests 66 each having a beverage support cavity 68 formed through a top surface 70 and an umbrella support aperture 71. Support cavity 68 is cylindrically shaped and has a three inch diameter to accommodate a container having up to about a three inch diameter.

Figure 6:
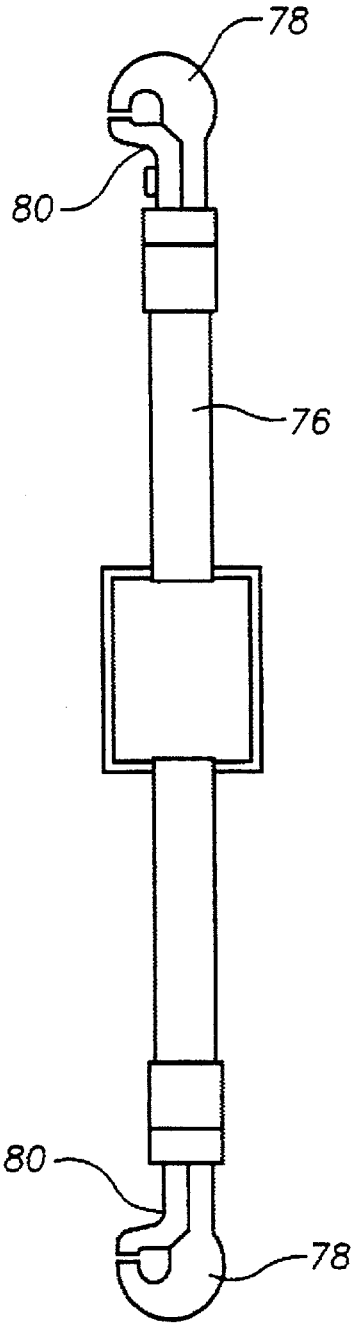
FIG. 6 is a side view of an optional carrying strap securable to the sports chair for aiding transport of the sports chair to and from sporting events.

Also shown in FIG. 5 is a pair of strap securing apertures 72 that are located at a top edge 74 of back support member 26. In use, a detachable carrying strap 76, shown in FIG. 6, is secured to sports chair 10 by inserting a hooked portion 78 of each clip member 80 through one of strap securing apertures 72. With reference once again to FIG. 5, a handle opening 82 is provided through back support member 26 to facilitate the carrying and folding and unfolding of sports chair 10.

Use of sports chair 10 is now described with general reference to FIGS. 1–6. Sports chair 10 may be carried to the sporting site by attaching carrying strap 76 in the manner previously described and placing carrying strap 76 over the shoulder. This allows for hands free carrying of sports chair 10. Cooler member 28 is carried with the free hands and umbrella 54 may be carried to the sports site by fucking umbrella 54 between the arm and torso. Upon arrival at the sporting event site, sports chair ten is unfolded and positioned in a desirable position with respect to the sporting activity location. Cooler member 28 is then inserted beneath seat support member 24 by sliding traveler members 36,34 into rail members 30,32 respectively. By storing cooler member 28 off of the ground and beneath seat support member 24 cooler member 28 is protected from resting on hot concrete or asphalt surfaces and shielded from direct sunlight. Umbrella 54 may be set up by inserting umbrella support pole 53 through one of the five resilient bushings 52 secured within the five cylindrically shaped apertures 50 or one of the umbrella support apertures 71 on arm rests 66. The resilient bushing 52 or umbrella support aperture 71 selected depends on the alignment of the sun with respect to the chair. If the sun is radiating from the left rear of the chair the left most bushing 52 is selected. If the sun is radiating from the right rear of the chair then the right most bushing 52 is selected. If the sun is radiating from a side of the chair, then an umbrella support aperture 71 is selected. Because the interior of each bushing frictionally contacts and grips support pole 53 the height of the umbrella may be adjusted also. Once umbrella 54 has been positioned and cooler member 28 stored the chair may be utilized in the convention manner of a collapsible chair. When it is desired to store an item such as sun screen, it may be placed with storage bag 18 until such time as it may be needed again. If the spectator is enjoying a beverage, the beverage container may be conveniently disposed within one of the beverage support cavities 68 formed in the arm rests 66. Once the sporting event has ended the setting up process is simply reversed. It can be seen from the preceding description that collapsible, portable sports chair that includes a mechanism for holding an umbrella in a variety of positions with respect to a spectator seated within the seat of the chair; that includes a mechanism for storing and maintaining a supply of beverages in a cool condition; and that includes a storage facility for conveniently storing items in connection with the chair when not immediately needed.

It is noted that the embodiment of the collapsible sports chair described herein in detail for exemplary purposes is of course subject to many different variations in structure, design, application and methodology. In particular, the collapsing chair assembly may take the form of any portable collapsing chair of the type previously described and should not be limited in any manner by the particular aspects discussed herein for exemplary purposes. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. In a collapsible sports chair having a collapsible chair assembly including a collapsing frame having four leg members, a seat support member supported by said four leg members, and a back support member hingedly connected to said seat support member, an improvement comprising:

a cooler assembly, including a rail mechanism and a cooler member slidably connected with said rail mechanism, secured beneath said seat support member, said rail mechanism including first and second parallel oriented, spaced rail members secured to a bottom surface of said seat support member, said first rail member having a first channel formed therein, said second rail member having a second channel formed therein, said cooler member having soft sides and including two carrying handles for carrying cooler member independently from said chair assembly, two traveler members that extend outwardly one each from a first and second top sidewall of said cooler member, each said traveler member being slidably disposable within said first and second channels in a manner such that said cooler member is slidable with respect to said seat support member, and a lid member hingedly secured to a cooler top surface of said cooler member covering an access opening formed through said cooler top surface into an insulated storage chamber formed within said cooler member, said lid member including a snap closure for securing said lid member over said access opening;

a multi-position umbrella support mechanism, secured to a back surface of said back support member, said umbrella support mechanism including an elongated member having at least three cylindrically shaped apertures formed therethrough and one tubular shaped resilient bushing adhesively secured within each of said cylindrically shaped apertures;

a flexible storage bag member having four flexible tether members each including a securing clip attached to a distal end thereof, each securing clip being insertable within one of four securing clip receiving members provided on said back surface of said back support member each said securing clip receiving member including a notch formed in a sidewall of said securing clip receiving member to provide a pathway for receiving a section of said tether member located adjacent said securing clip;

a pair of arm rests secured to said back support member, each said arm rest including a beverage support cavity formed through a top arm rest surface, each beverage support cavity being cylindrically shaped; and a flexible carrying strap having a first and second securing mechanism, each securing mechanism having a hooked portion;

said back support member including a pair of strap securing apertures formed through a top portion thereof, each said hooked portion of said first and second securing mechanisms being insertable through one of said pair of strap securing apertures in a manner to secure said carrying strap to said back support member.

* * * * *